US009510419B2

(12) United States Patent
Bell et al.

(10) Patent No.: US 9,510,419 B2
(45) Date of Patent: Nov. 29, 2016

(54) TEMPERATURE ADJUSTED DIMMING CONTROLLER

(71) Applicant: ABL IP Holding LLC, Conyers, GA (US)

(72) Inventors: Robert Bell, Erin (CA); Garrett Douglas, Calgary (CA)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 14/947,228

(22) Filed: Nov. 20, 2015

(65) Prior Publication Data

US 2016/0150616 A1 May 26, 2016

Related U.S. Application Data

(60) Provisional application No. 62/082,309, filed on Nov. 20, 2014.

(51) Int. Cl.
*H05B 33/08* (2006.01)
*H05B 41/44* (2006.01)
(Continued)

(52) U.S. Cl.
CPC ..... *H05B 33/0863* (2013.01); *F21V 14/08* (2013.01); *H05B 37/0209* (2013.01); *H05B 41/44* (2013.01)

(58) Field of Classification Search
CPC ..... H05B 33/0833; H05B 33/0845; H05B 33/0863; H05B 37/0209; H05B 41/38; H05B 41/44; H05B 39/041
USPC ..... 315/294, 161, 224, 291, 300, 302
See application file for complete search history.

(56) References Cited

U.S. PATENT DOCUMENTS 7,514,884 B2 4/2009 Potucek et al.
8,344,665 B2 1/2013 Verfuerth et al.
(Continued)

FOREIGN PATENT DOCUMENTS

EP 0495305 7/1992
EP 2503854 9/2012
(Continued)

OTHER PUBLICATIONS

Non-Final Office Action for U.S. Appl. No. 13/837,533, mailed Oct. 9, 2014, 9 Pages.
(Continued)

*Primary Examiner* — Jimmy Vu
*Assistant Examiner* — Henry Luong
(74) *Attorney, Agent, or Firm* — Kilpatrick Townsend & Stockton, LLP

(57) ABSTRACT

Systems and methods are disclosed for adjusting the correlated color temperature (CCT) reflecting the warmth of emitted light for a non-tungsten based lighting device as intensity of the lighting device is modified. The CCT of the non-tungsten based lighting device is determined at a lighting control device that can provide fixture-dependent driver levels to various lighting devices of varying types. A lighting controller engine can determine a white component color temperature value based on a desired intensity level and a default CCT value received via a user interface of the lighting control device. The lighting control device can determine the driver levels for controlling characteristics of light emitted from the non-tungsten based lighting device based on the white component color temperature value and a user defined color level. The lighting control device can scale the white component color temperature to reflect variations of warmth as the intensity level is adjusted.

20 Claims, 4 Drawing Sheets

(51) Int. Cl.

| | |
|---|---|
| ***F21V 14/08*** | (2006.01) |
| ***H05B 37/02*** | (2006.01) |

(56) References Cited

U.S. PATENT DOCUMENTS

| | | | | |
|---|---|---|---|---|
| 9,014,828 | B2 | 4/2015 | Martello et al. | |
| 2011/0137757 | A1 | 6/2011 | Paolini et al. | |
| 2011/0169430 | A1 | 7/2011 | Kirkup | |
| 2011/0187290 | A1 | 8/2011 | Krause | |
| 2012/0038291 | A1* | 2/2012 | Hasnain ..... | H05B 33/0857 315/294 |
| 2012/0112662 | A1 | 5/2012 | Hatley et al. | |
| 2012/0176063 | A1 | 7/2012 | Hatley et al. | |
| 2013/0221872 | A1 | 8/2013 | Gan et al. | |
| 2013/0249433 | A1 | 9/2013 | Martello et al. | |

FOREIGN PATENT DOCUMENTS

| | | |
|---|---|---|
| KR | 101069269 | 10/2011 |
| WO | 02067070 | 8/2002 |
| WO | 2004086824 | 10/2004 |

OTHER PUBLICATIONS

Notice of Allowance for U.S. Appl. No. 13/837,533, mailed Jan. 22, 2015, 8 pages.

Extended European Search Report for European Application No. EP 13160737.6, mailed Dec. 1, 2015, 13 pages.

horizoncontrol.com, "The Abstract Control Model," White Paper, Horizon, Available online at http://www.pathwayconnect.com/images/stories/support/HCIWhitePaper-2005-02-21-ACM.pdf, 2005, 30 pages.

* cited by examiner

TEMPERATURE ADJUSTED DIMMING CONTROLLER

RELATED APPLICATIONS

This application claims priority to U.S. Application No. 62/082,309, Temperature Adjusted Dimming Control, filed Nov. 20, 2014, which is now incorporated herein by reference.

TECHNICAL FIELD

This disclosure relates generally to aspects of a lighting controller, including systems and methods for automatically adjusting color attributes of a lighting device to control the correlated color temperature of light emitted from the lighting device as intensity is adjusted.

BACKGROUND

Lighting controllers are used to control lighting devices in settings that utilize large arrays of lighting equipment. Lighting controllers can control various characteristics of the light emitted from the individual lighting devices. For example, lighting controllers can adjust the intensity and color of the individual lighting devices in a lighting array. It is desirable to adjust the properties of light emitted from non-tungsten-based lighting devices so that the emitted light is adjusted similar to the emitted light of a traditional tungsten-based lighting device.

For example, the correlated color temperature (CCT) property of emitted light indicates the temperature of the color of the light measured in Kelvin. The CCT property can help specify the shade of "white" that is being radiated from a white light source. The CCT property of emitted light helps provide a color tone for the white light in a spectrum of warmth. For example, a light source emitting a white light with a lower CCT value (e.g., below 3200 Kelvin) corresponds to a warmer light (an amber tinged white). A light source emitting a white light with a higher CCT value (e.g., above 6,000 Kelvin) corresponds to a cooler light (a bluish white light). The CCT property of emitted light can also be characterized as the shade of white that is experienced in everyday life. For example, "candlelight" white is typically considered white light around a CCT of 1800 Kelvin. "Household" white light is typically considered white light around a CCT of 2800 Kelvin. And "daylight" white light is typically considered white light around a CCT of 5600 Kelvin.

In traditional tungsten-based lighting units, the CCT is naturally adjusted as the lighting unit increases or decreases in intensity. As a tungsten lighting unit dims, the CCT value of the tungsten lighting unit decreases, resulting in a warmer tone in the overall color gamut. The natural drop in CCT, providing the effect of a warmer color tone, is an artifact of the electrical properties of a black body radiator. Non-tungsten lighting devices, however, do not naturally shift the color nor the color temperature of the produced light when dimming. Examples of non-tungsten lighting devices can include solid state lighting devices, such as light-emitting diodes (LEDs), or gas discharge lighting sources such as arc lamps. It is therefore desirable to automatically adjust the warmth (CCT property) of the light emitted by a lighting unit as the intensity of the lighting device is modified.

SUMMARY

Systems and methods are disclosed for adjusting, at a lighting control device, color attributes of connected non-tungsten based lighting devices to control the correlated color temperature (CCT) of white light emitted from the non-tungsten based lighting devices as intensity is modified. An example system includes a lighting control device with a user interface module and a lighting controller engine. The user interface module can receive inputs from an operator specifying a desired intensity level, default CCT values, and a color setting for the non-tungsten based lighting devices. A color converter module in the lighting controller engine can receive the color settings from the user interface and translate the color setting to a color component (e.g., the primary color selected) and a saturation component (e.g., the vividness of the color). The default CCT values can include, for example, a maximum CCT value indicating the desired warmth of light when intensity is set to 100%, and/or a minimum CCT value indicating the desired warmth of light when intensity is set to minimum. The maximum CCT value is used to normalize the CCT range of the various lighting devices connected to the lighting control device. The default CCT values can include a CCT shift value, which can be pre-determined or received via user input in the color converter module. A CCT shift value indicates the number of Kelvin units the light emitted by the lighting device should adjust as intensity decreases from maximum to minimum. Based on the received default CCT values and the intensity level, a dim-to-warm module in the lighting controller engine can calculate a white component color temperature output as a function of the intensity level. The white component color temperature can be a CCT value in Kelvin units that corresponds to the warmth of emitted light as a function of the intensity when the received color setting is white.

The user set intensity level, white component color temperature, color component, and saturation component can be provided to a translator control module in the lighting controller engine. Based on the inputs, the translator control module determines the appropriate fixture-dependent driver levels to control the characteristics of emitted light from the connected lighting devices. For example, if a connected lighting device is a solid state lighting device, the driver levels include specific electrical inputs for controlling the individual red, blue, green, amber and/or other light emitting diodes within the solid state lighting device to collectively emit light with the desired characteristics. If the connected lighting device is a gas discharge lamp, the driver levels include commands to drive motors connected to the gas discharge lamp. The motors can introduce graduated filters of varying colors so that the gas discharge lamp emits light with the desired characteristics. When the received color setting is a non-white color, the driver levels output from the translator control module may be a function of color (e.g., hue) component, saturation component, and intensity component. When the received color setting is a white color, the driver levels output from the translator control module may be a function of the white component color temperature. As the intensity setting is adjusted for a white color, the driver levels output from the translator control module control the non-tungsten based lighting devices such that the CCT value of the emitted light substantially mimics that of a tungsten-based lighting device. The CCT value represents the "warmth" of the emitted light.

The lighting control device can continue to adjust the white component color temperature and effectively the outputted driver levels to reflect variations of the warmth of the emitted light as the intensity level is adjusted. For example, as the intensity level is increased, the dim-to-warm module can scale the white component color temperature and the translator control module can scale the driver levels as a function of the adjusted intensity. The adjusted driver levels adjust the characteristics of emitted light from the lighting device such that the emitted light includes an increased emitted CCT value (i.e. the emitted light exhibits a "warmer" tone). As the intensity level is decreased, the dim-to-warm module can scale the white component color temperature and the translator control module can modify the driver levels such that the emitted light from the lighting control device includes a decreased emitted CCT value (i.e. the emitted light exhibits a "warmer" tone).

These illustrative aspects and features are mentioned not to limit or define the invention, but to provide examples to aid understanding of the inventive concepts disclosed in this application. Other aspects, advantages, and features of the present invention will become apparent after review of the entire application.

BRIEF DESCRIPTION OF THE FIGURES

These and other features, aspects, and advantages of the present disclosure are better understood when the following Detailed Description is read with reference to the accompanying drawings, where.

DETAILED DESCRIPTION

Systems and methods are provided for automatically adjusting, at a lighting control device, color attributes of a lighting device to control the correlated color temperature (CCT) of light emitted from the lighting device as intensity of the lighting device is adjusted. A lighting control device can receive inputs from a user interface specifying the desired color, intensity, and default CCT values (e.g., CCT values at 100% intensity and near zero intensity) of emitted light for each lighting device connected to the lighting control device. The lighting control device can determine the appropriate driver levels and adjust the CCT of emitted light from each lighting device as intensity is modified. Automatically adjusting the CCT of emitted light at the lighting control device instead of at the individual lighting devices allows an operator to utilize off-the-shelf lighting devices, of varying makes and models. Thus, simple lighting devices without the dedicated hardware or software for adjusting the CCT of emitted light can be installed in a setting that utilizes large arrays of lighting equipment, such as a theater, performance hall, stadium, or other venue.

Figure 1:
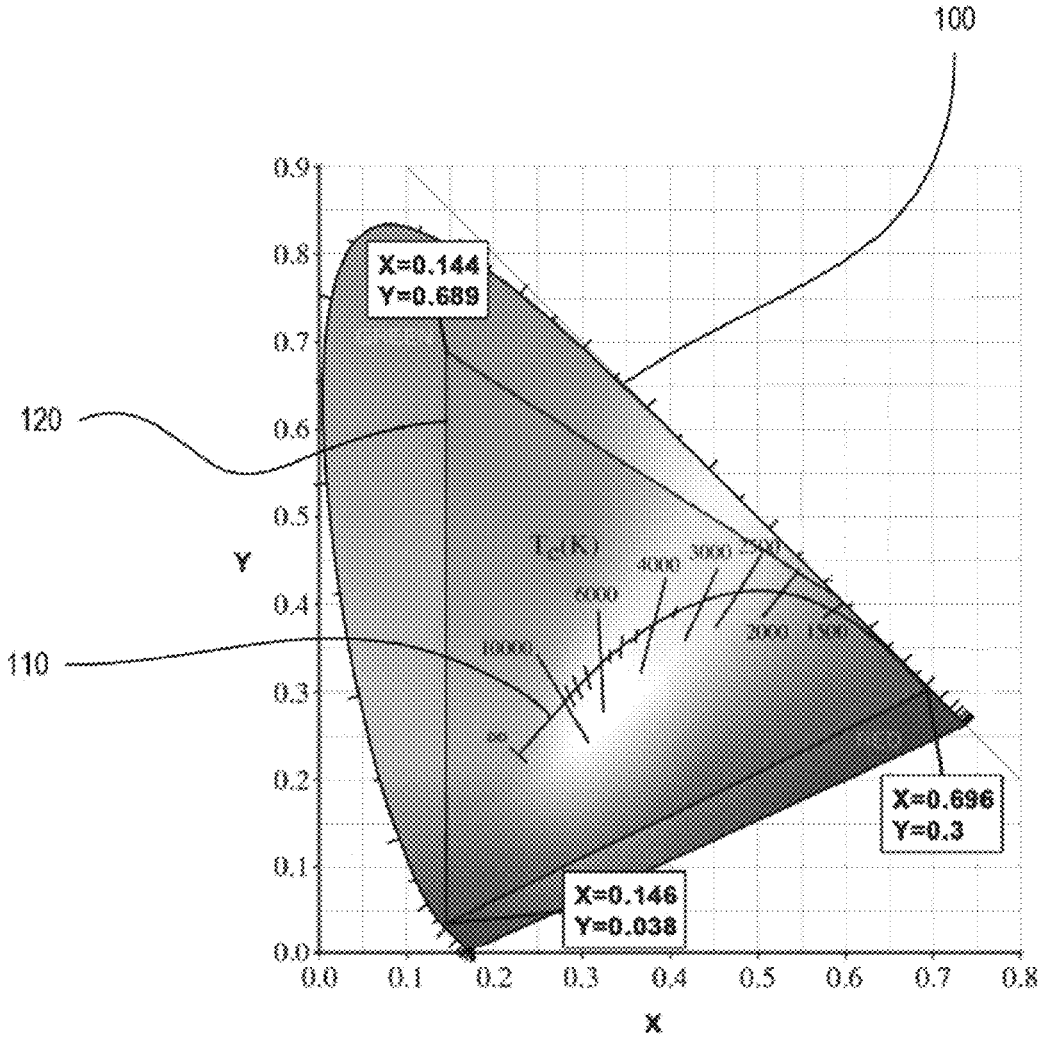
FIG. 1 is a diagram illustrating an example spectrum color gamut displaying the range of possible chromacities and the blackbody line for white levels, along with the attainable gamut for a given fixture.

Multiple lighting devices, of varying types and models, can be connected to and controlled by the lighting control device. For example, a lighting control device can drive output levels to adjust characteristics of emitted light for non-tungsten based devices, such as solid state lighting devices (e.g., light emitting diodes (LEDs) and gas discharge lamps (e.g., arc lamps). A lighting control device can automatically adjust the CCT value of emitted light for a non-tungsten based light source to substantially mimic the blackbody line in a color gamut and thus emulate the characteristics of a tungsten based light source. FIG. 1 illustrates an example spectrum color gamut 100 displaying the range of possible chromacities. FIG. 1 also depicts a region 120 that represents the attainable color gamut for the light source. The corners of the region 120 depict the three primary colors—red, blue, and green. The color gamut 100 includes a blackbody line 110 that indicates the varying degrees of white that exist in the color gamut 100. For example, as shown by the black body line 110, a lighting device emitting a light with a CCT around 2000 Kelvin corresponds to an amber colored white light. As the CCT value of the emitted white light increases, the white light cools and portrays a yellowish then bluish aspect.

To shift the CCT value of emitted light for a solid state lighting device in response to decreasing the intensity of the solid state lighting device, the lighting control device can increase the driver level applied to red/amber emitters and decrease the driver level applied to blue emitters included in the solid state lighting unit. Similarly, to shift CCT value of emitted light for a solid state lighting device in response to increasing the intensity of the solid state lighting device, the lighting control device can decrease the driver level applied to red/amber emitters and increase the driver level applied to blue emitters in the solid state lighting device.

To modify the CCT value of emitted light from an arc lamp, the lighting control device can send a command to introduce graduated optical filters of different colors. For example, various combinations of a cyan filter, a magenta filter, and a yellow filter can provide a range of colors. To shift the CCT value of emitted light for an arc lamp in response to increasing the intensity of the arc lamp, the lighting control device can send a command to introduce cyan and magenta filters to the arc lamp output, thereby emitting a bluish white light from the arc lamp. To shift the CCT value of emitted light for an arc lamp in response to decreasing the intensity of the arc lamp, the lighting control device can send a command to introduce an amber or yellow and magenta filters to the arc lamp output, thereby emitting an amber colored white light from the arc lamp.

Figure 2:
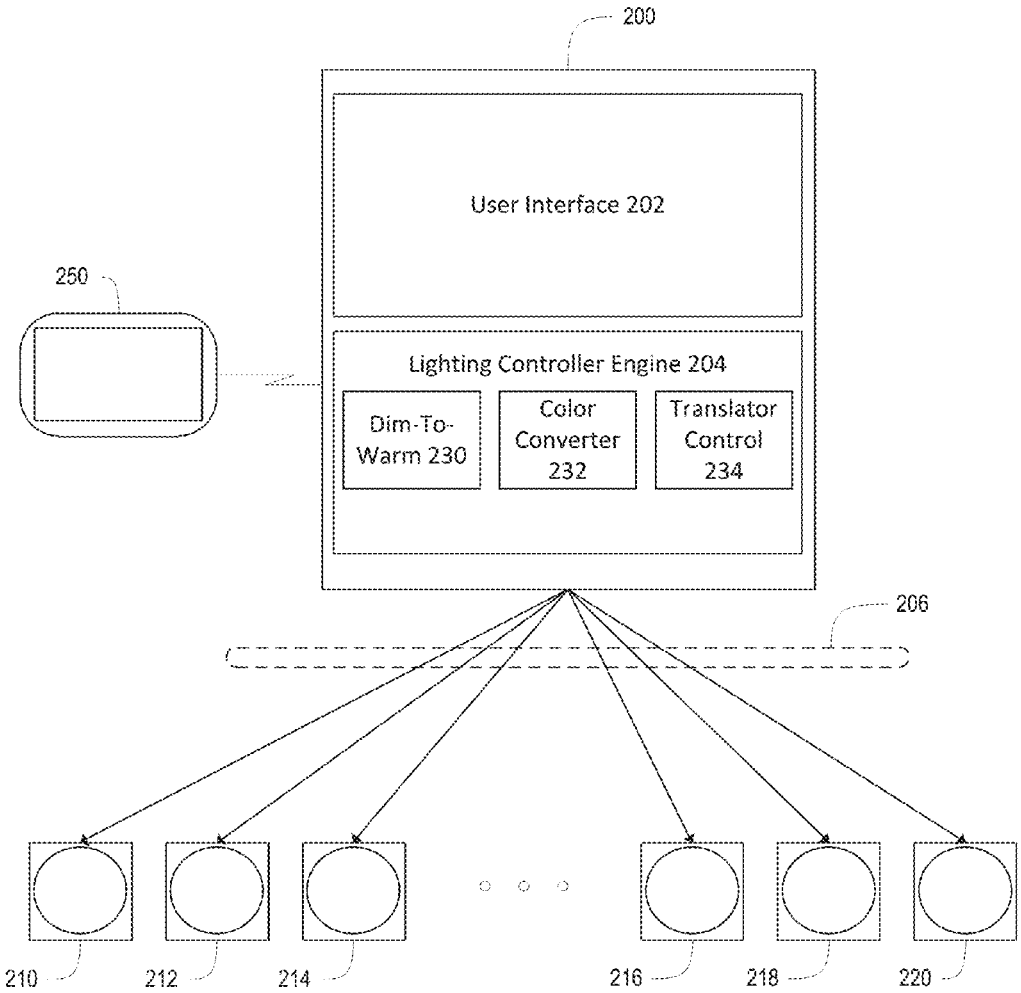
FIG. 2 is a block diagram illustrating an example operating environment for a lighting control device that can adjust the CCT of emitted light in connected non-tungsten based lighting devices.

Embodiments disclosed herein thus provide for a lighting control device that can automatically adjust the CCT properties of multiple connected lighting devices as intensity is modified. FIG. 2 is a block diagram illustrating an operating environment for a lighting control device that can adjust the CCT of emitted light in connected non-tungsten based lighting devices. The lighting control device 200 controls a number of lighting devices 210-220 by sending various commands or control signals. The signals may be communicated via a variety of types of wired or wireless connections via a common interface 206. For example, lighting units 210-220 can connect to the lighting controller engine 204 via a common interface standard (e.g., the ANSI E1.11 DMX512 protocol). The lighting controller includes a lighting controller engine 204 and a user interface module 202 and supports an optional handheld computing device 250.

The lighting controller engine 204 can determine the signals to transmit to the lighting devices 210-220 in order to adjust the warmth of a lighting device as intensity changes. As used herein, a lighting device can refer to any non-tungsten based light source. Automatically adjusting CCT levels of multiple lighting devices 210-220 via a single lighting control device allows an operator to utilize lighting units that implement a common interface 206, but different types of lighting units (e.g., solid state lighting, gas discharge lamps) and different controls for the same "white." Embodiments disclosed herein allow an operator for a venue, such as a theater or other performance hall, to flexibly adjust lighting properties from a lighting control device. While a theater or performance hall is mentioned for exemplary purposes, it is understood that embodiments of the disclosure herein can be applied to any venue that uses lighting devices.

The lighting control device 200 allows an operator to input setup parameters via the user interface module 202. Setup parameters specify the initial, default characteristics for light emitted from connected lighting devices 210-220 prior to operation of the lighting devices 210-220. For example, the lighting control device 200 may receive, via user interface module 202, setup parameters defining inputs specifying initial color levels, intensity levels, and the maximum and minimum CCT values when the color level is set to a white light color. The setup parameters may be received, for example, prior to the start of a show in a theater or performance hall or other venue. The lighting control device 200 may also receive runtime inputs during the operation of the lighting devices 210-220. For example, the lighting control device 200 may receive, via user interface module 202, runtime inputs defining new values for color levels and intensity levels, and default CCT values. Driver levels output from the lighting control device 200 are adjusted according to the new values. For example, the operator may specify during runtime that the color level output from lighting control device 210 should change from red to white and the intensity gradually decrease from 80% to 50%. The lighting control device 200 can translate the inputs such that the output driver levels control the lighting device 210 to emit a white color with a warmth characteristic according to the default CCT values input during setup.

The lighting control engine 204 translates the setup parameters and the runtime inputs received via the user interface 202 to the driver levels output to control the lighting devices 210-220. The lighting controller engine 204 can include a dim-to-warm module 230, a color converter module 232, and a translator control module 234. The user interface module is customizable so that the user interface may be adapted for different applications or for different users. The user interface module 202 provides the user with an intuitive interface so that the user may specify descriptive values, absolute or relative values for the desired results. The user interface module 202 insulates a user from having to calculate the exact values needed to control the lighting devices 210-220 or to take into account differences between the lighting devices 210-220. For example, a user may specify a color for a lighting device 210, such as purple, by adjusting one or more inputs. The color inputs are provided to the color converter module 232 within the lighting controller engine 204, and the color converter module 232 determines the color component values and saturation component values to send to the translator control engine 234. The user may also specify desired intensity level for lighting device 210 and default CCT values (e.g., the desired CCT level of the emitted light when the intensity levels are 100% and near zero). The input CCT values normalize the ranges of the connected lighting devices 210-220. For example, the technical specifications and design characteristics of lighting device 210 may limit the maximum CCT of emitted light at full intensity at 6300 Kelvin. Similarly, lighting device 212 may emit light with a limited maximum CCT value of 6200 Kelvin. By receiving an input (e.g., 6000 Kelvin) for a maximum CCT value, CCT of emitted light for all connected lighting devices 210-220 (or a subset of lighting control devices 210-220 indicated by user selection) are configured to emit light with a CCT of the indicated maximum (e.g., 6000 Kelvin).

The dim-to-warm module 230 in the lighting controller engine 204 can receive user set intensity levels for the lighting devices 210-220 as well as desired CCT values for maximum CCT and minimum CCT. Instead of a minimum CCT value, the lighting controller engine 204 can also receive user a desired CCT shift value, which indicates the number of Kelvin units by which the CCT of the emitted light should adjust as intensity is reduced from maximum to minimum. In some embodiments, the lighting controller engine 204 is configured with a pre-determined CCT shift value. Based on the received intensity values and the CCT maximum, CCT minimum, and/or CCT shift values, the dim-to-warm module 230 can determine white component color temperature outputs to send to the translator control module 234. The translator control module 234 translates the color component, saturation component, and white color component into the absolute or fixture-dependent values needed to control the lighting devices 210-220 and output light with the desired characteristics. For non-white color component, the translator control module 234 may not utilize the white component color temperature in determining the driver levels to selected lighting devices 210-220. If the user specifies that the color component is a white color, the driver levels output to the selected lighting devices 210-220 is based on the white component color temperature (i.e. to substantially mimic the varying degrees of warmth for white in a blackbody line in a tungsten based lighting source). If the user specifies the same effects for multiple lighting devices 210-220 that have different control interfaces, then the translator control module 234 determines the respective values to send to each of the different lighting devices 210-220.

The lighting controller engine 204 and the user interface module 202 may be implemented using any combination of computer hardware and software. For example, software for the lighting controller engine 204 (including software for the dim-to-warm module 230, color converter module 232, and translator control module 234) and the user interface module 202 may be stored as computer-executable instructions on a computer-readable medium. The computer-readable medium may be a non-transitory computer-readable medium, such as a hard disk drive, solid state drive, flash memory, or other non-transitory storage media. The lighting control device 202 may include one or more processing devices for rendering the user interface 200 and executing programming code for implementing the functions of the lighting controller engine 204. For example, processing devices in the lighting control device 200 can execute program code stored in a computer-readable medium to perform the operations of the dim-to-warm module 230, color converter module 232, and the translator control module 234.

An example of a lighting control device 200 is the Cognito™ lighting console from Pathway Connectivity Solutions. Further detailed examples of an operation of a lighting control device 100 is provided in U.S. patent application Ser. No. 13/837,533 ("Lighting Controller"), which is incorporated by reference herein.

Figure 3:
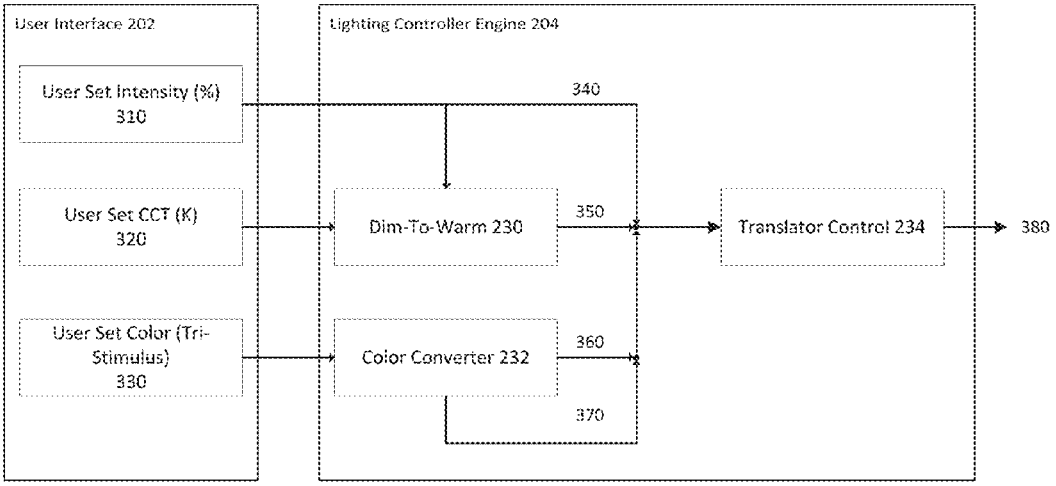
FIG. 3 is a logical block diagram illustrating further details of the user interface and lighting controller engine from the lighting control device in FIG. 2.

FIG. 3 is a logical block diagram depicting further details of the signaling within the user interface 202 and lighting control engine 204 to automatically adjust the driver levels of lighting devices 210-220 in order to emit varying degrees of warmth based on intensity, default CCT values, and color settings. The user interface 202 can include one or more input interfaces for receiving inputs based for intensity level, CCT, and color.

For example, user interface 202 can include an input interface 310 for receiving inputs for the general intensity for a lighting device. The intensity level can correspond to the brightness emitted by the lighting device.

The user interface 202 can also include an input interface 330 for receiving inputs specifying a user set color level. In one example, the lighting control device 200 can accept inputs according to a tri-stimulus color system (such as specifying Red-Green-Blue levels or Cyan-Yellow-Magenta color levels). For example, the operator can specify relative ratios of red, green, and blue to include in the produced light, thereby allowing the operator to select any color from a wide color gamut. For example, the operator can indicate a purple color by entering a certain ratio of red and blue but no green. As another example, the operator can indicate an aqua color by entering a certain radio of blue and green but no red. The lighting control device 200 can also accept inputs specifying color according to a Hue-Saturation-Intensity model. Hue can represent the specific shade of a color as it is found in the color spectrum (e.g., solid red, green, or blue). An input of zero degrees hue is commonly referenced as the color "red." The saturation of a color can represent how "pure" or vivid the color is. The intensity component of a huge-saturation-intensity model can represent the "brightness" of a color. The lighting control device thereby allows the user to input a color from a wide color gamut. Thus, for example, a tri-stimulus input of 0 degrees hue, 100% saturation, and 100% intensity can correspond to a pure, vivid red. A tri-stimulus input of 0 degrees hue, 0% saturation, and 100% intensity can correspond to a bright white. A hue of 0 degrees, 50% saturation, and 100% intensity can correspond to the color pink. And a hue of 0 degrees, 0% saturation, and minimum intensity can correspond to the color black. While specific tri-stimulus models for entering color information into a lighting control device 200 are discussed above, other embodiments for entering color are also considered. For example, the lighting control device can include an interactive graphical user interface that allows the operator to select a color from a color spectrum or color gamut via a variety of inputs.

The user interface 202 can also include an input interface 320 for accepting inputs specifying default CCT values in Kelvin units. A maximum CCT value indicates the desired CCT level of the emitted light when the intensity level is set to 100% intensity. As mentioned above, the maximum CCT value normalizes the range of CCT of the emitted light for the various connected lighting devices 210-220, each of which may have different potential CCT ranges due to hardware and design differences. Similarly, a minimum CCT value indicates the desired CCT level of the emitted light when the intensity level is set to minimum intensity. The input interface 320 may also be configured to receive an input specifying a CCT shift value, indicating the desired number of Kelvin units by which emitted light should adjust as the intensity decreases from maximum intensity (e.g., 100%) to minimum intensity (e.g., near zero intensity).

The user interface 202 can provide options for selecting and controlling the characteristics of one or more lighting devices connected to the lighting control device 200. For example, the user interface 202 can receive inputs selecting one or multiple lighting devices via a touchscreen, physical switches, or other user interface elements. The user may specify that the same lighting characteristics in input interfaces 310-330 should be applied to multiple lighting devices. Alternatively, the user specify that each connected lighting device receives different lighting characteristics from input interfaces 310-330.

The selections received from the user interface 202 are provided to the lighting controller engine 204. For example, the user set color level from input interface 330 is provided to the color converter module 232 in the lighting controller engine 204. The color converter module 232 determines a color component 360 and a saturation component 370 from the user set color level. The color component 360 can indicate, for example, the primary color from color gamut 100 (Red, Green, Blue). The saturation can indicate the "vividness" or purity of the color component 360. For example, a saturation component 370 of 100% and a color component 360 of "red" (e.g., zero degrees hue) can indicate a deep, vivid red (e.g., a "pure" red). As the saturation drops, the red color softens to lighter shades of red, and then pink. A saturation component 370 of zero can indicate a white color output when at 100% intensity.

The user set intensity level from input interface 310 and the user set default CCT values from input interface 320 are provided to the dim-to-warm module 230. Based on the user set intensity value and the default CCT values as inputs, the dim-to-warm module 230 determines a white component color temperature 350. The white component color temperature 350 indicates the emitted CCT value that is scaled based on the user set intensity. Various algorithms can be used to determine how the dim-to-warm module 230 scales the white component color temperature 350 based on the user set default CCT values and user intensity level. For example, in one embodiment, the dim-to-warm module 230 can determine the white component color temperature 350 linearly based on the following formula:

$$CCT_{Out}=CCT_{Max}-((CCT_{Max}-CCT_{Min})\times I)$$

In the formula above, $CCT_{Out}$ corresponds to the white component color temperature 350, $CCT_{Max}$ corresponds to the maximum CCT value set via input interface 320 (e.g., the white component color temperature 350 for 100% intensity), $CCT_{Min}$ corresponds to the minimum CCT value set via input interface 320 (e.g., the white component color temperature 350 at the lowest intensity setting, such as intensity near zero), and I corresponds to the user set intensity level via controller interface 310.

For example, a lighting operator for a theater may require lighting devices in the theater to output white light at absolute values—3200 Kelvin when at 100% intensity and 1800 Kelvin when at minimum intensity. Alternatively, the lighting operator may enter inputs on a lighting control device to indicate desired emission based on descriptive values—"candlelight" white light when at minimum intensity and "theater" white light when at 100% intensity (minimum CCT value and maximum CCT value, respectively). The lighting devices may each have different actual CCT ranges due to hardware and design differences. For example, lighting device 210 may emit light at a maximum CCT potential of 4000 Kelvin and lighting device 212 may emit light at a maximum CCT potential at 5000 Kelvin. The lighting operator enters inputs on the lighting control device to normalize these ranges to the desired emission characteristics.

In this example, the lighting control device 100 may receive, via inputs from the input interface 320, a maximum CCT value of 3200 Kelvin and a minimum CCT value of 1800 Kelvin. The received maximum CCT value of 3200 Kelvin and minimum CCT value of 1800 Kelvin normalize the ranges of the lighting devices. The lighting control device 200 may also receive a user set color level from input interface 330 for a white color. The lighting control device 200 may also receive, via inputs from the input interface 310, a desired intensity level for the lighting device. If the lighting operator entered 100% intensity, then the dim-to-warm engine can output 3200 Kelvin as the white component color temperature 350. If the lighting control operator entered minimum intensity, then the dim-to-warm engine can output 1800 Kelvin as the white component color temperature 350. If the lighting control operator entered 50% intensity, then, based on the formula above, the dim-to-warm module can output 2500 Kelvin (3200K−(3200K−1800K)×0.5)) as the white component color temperature 350.

As another example, the lighting control device 100 and the dim-to-warm module 230 determine the white component color temperature 350 based on the received maximum CCT value input and a CCT shift value. To normalize the CCT range of connected lighting devices, lighting control device 100 may receive input specifying a maximum CCT value of 3200 Kelvin. The CCT shift value may be pre-determined and coded into the program code for the lighting control device 100. The dim-to-warm engine 230 outputs a white component color temperature 350 equal to the maximum CCT value when the received intensity level is maximum and scales down the white component color temperature 350 as a function of the CCT shift value as the received intensity level decreases in value. For example, the CCT shift value may be pre-determined as 1700 Kelvin, indicating that the entered maximum CCT value should linearly shift down by a value of 1700 Kelvin as intensity is reduced to a minimum level (e.g., near zero) . If the lighting control operator entered 100% intensity, then the dim-to-warm engine 230 outputs 3200 Kelvin as the white component color temperature 350. If the lighting control operator entered minimum intensity, then the dim-to-warm engine 230 outputs 1500 Kelvin as the white component color temperature 350 (difference of the maximum CCT value of 3200 Kelvin and CCT shift value 1700 Kelvin). While the above example specifies that the CCT shift value is pre-determined, the CCT shift value may also be configurable and received as a user input.

While specific algorithms to calculate the white component color temperature are displayed above for illustrative purposes, it is understood that various algorithms are considered and can be implemented in the dim-to-warm module. For example, the dim-to-warm module can also scale the white component color temperature 350 for a given intensity with an algorithm resulting in non-linear modification of $CCT_{Out}$.

The user set intensity level 340, the white component color temperature 350, the color component 360, and the saturation component 370 can be provided to the translator control module 234 within the lighting control device 200. An example of a translator control module is the Translator Control Model used in Horizon Control, Inc. products. The translator control module 234 determines, based on the given inputs, the appropriate driver levels 380 to provide to connected lighting devices 210-220 to control the characteristics of the emitted light from lighting devices 210-220. For example, the translator control module 234 can translate the inputs to instructions to drive connected lighting devices 210-220 connected to the lighting control device 200 via the ANSI E1.11 DMX512 protocol. Thus, the translator control module 234 determines fixture-dependent values (i.e. driver levels uniquely identified for each type of connected lighting device 210-220) needed to produce the desired lighting characteristics for each of the connected devices 210-220.

For example, as mentioned above, the connected lighting devices 210-220 can comprise varying types of non-tungsten based lighting devices, such as solid state lighting devices and gas discharge lighting devices. The lighting devices 210-220 may have different capabilities—for example different lighting devices 210-220 may have different ranges of motion so that different input voltages are needed to place the lights at the same angle. As another example, different lighting devices 210-220 may have different color characteristics, so that to get the same color out of each different voltages/electrical inputs or other control stimuli are needed. Driver levels output to lighting devices 210-220 can translate inputs received via user interface 202 to the correct voltages and electrical inputs specific for the lighting devices 210-220 such that the lighting devices 210-220 emit light with the intended characteristics.

Thus, the solid state lighting devices and the gas discharge lighting devices may include lighting devices of varying types and models, each with different control interfaces (e.g., interfaces for controlling the characteristics of the emitted light). As such, each non-tungsten based lighting device may require fixture-dependent values for controlling the characteristics of the emitted light. The translator control module 234 can determine the appropriate driver levels 380 to automatically adjust the characteristics of both solid state lighting devices and gas discharge lighting devices by determining the fixture-dependent control values for each lighting device.

To adjust the produced color and white levels of a solid state lighting device, driver levels 380 can include the specific electrical inputs to turn on or off light emitting diodes in solid state lighting units (e.g., red, blue, green, amber, or other emitters in a LED, where the individual emitters can be controlled by provided driver levels). The translator control module 234 can also determine the intensity levels to drive the red-green-blue emitters and amber emitters in any solid state lighting device. When user set color level for input interface 330 is a white color, and as inputs specifying different intensity levels are received via input interface 310, the translator control module 234 can determine the electrical inputs to gradually turn on and off emitters to adjust the CCT value and thus the warmth of the emitted white light.

To adjust the produced color and white levels of an arc lamp, driver levels 380 can include commands for a processing device driving motors to apply graduated filters of different colors to adjust the produced color of an arc lamp. As inputs specifying different intensity levels are received via input interface 310, the translator control module 234 can determine the commands for applying graduated filters to the connected arc lamps to automatically adjust the CCT value of the emitted white light.

The present disclosure thus allows automatic adjustment of lighting warmth (CCT value) of emitted light as the intensity of the lighting unit is modified at the lighting control device 200. Connected lighting devices 210-220 can include any lighting device that follows a standardized protocol (such as DMX512) for communicating with the lighting control device. Automatically adjusting CCT values at the lighting control device 200 allows an operator to install off-the-shelf lighting devices that follow the required standard, regardless of the make, model, or mode of the connected lighting devices. Modifying the CCT attribute of a lighting device at runtime as a function of intensity allows simple lights (those without dedicated processing hardware for adjusting CCT) to automatically emit warmer tones as intensity is decreased. Modifying the CCT attribute for non-tungsten based lighting sources as a function of intensity at runtime can substantially mimic the adjustments to the warmth emitted light from a tungsten-based light source as intensity is adjusted.

Figure 4:
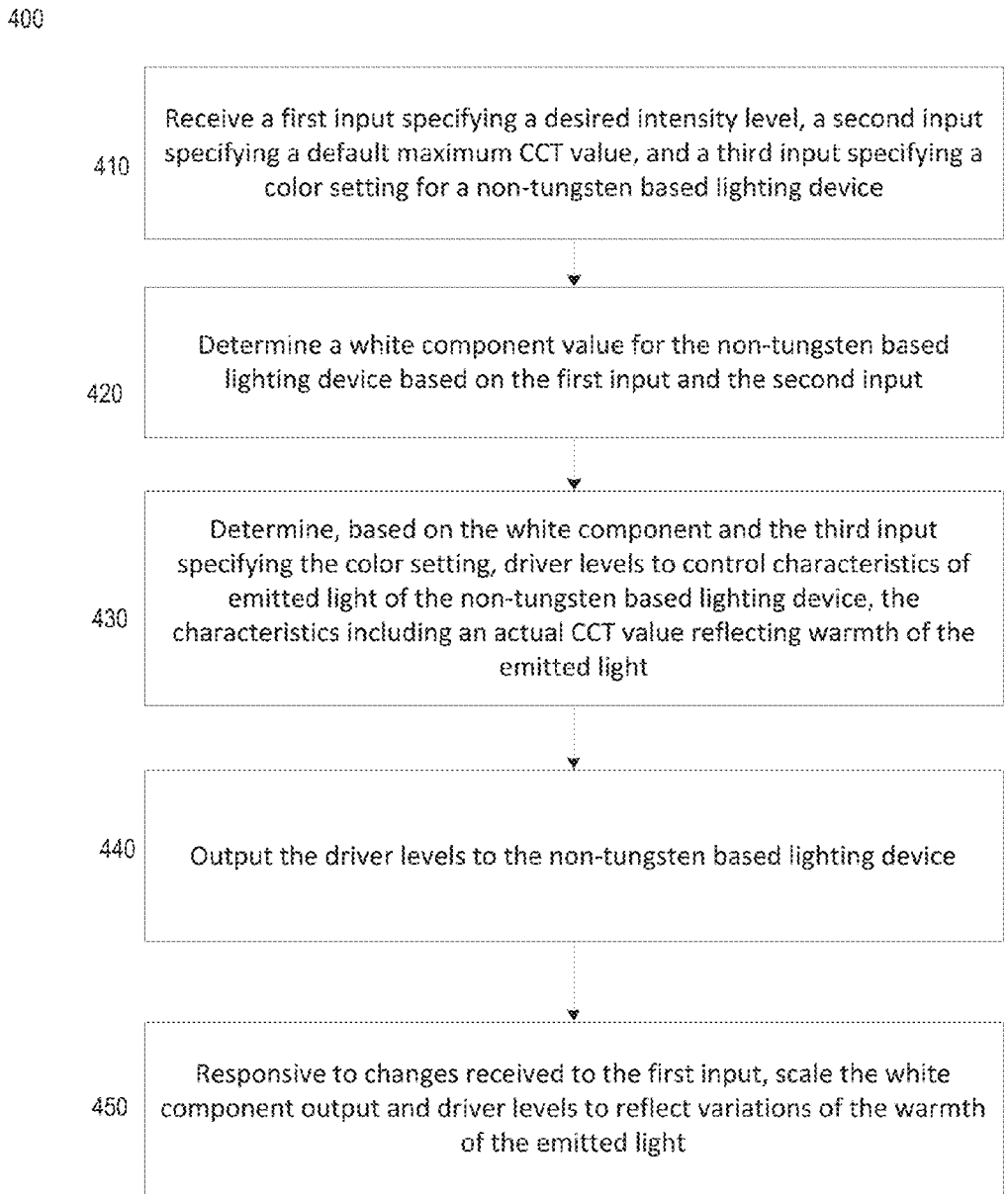
FIG. 4 is a flowchart depicting an example process for adjusting the CCT of emitted light in a non-tungsten based lighting device as a function of user set intensity levels.

FIG. 4 is a flowchart depicting an example of a method 400 for automatically adjusting the lighting warmth of emitted light in non-tungsten based lighting devices as the intensity levels are modified. For illustrative purposes, the method 400 is described with reference to the system implementations depicted in FIGS. 2-3. Other implementations, however, are possible.

The method 400 includes receiving a first input specifying a desired intensity level, a second input specifying a maximum CCT value, and a third input specifying a color setting for a non-tungsten based lighting device, as shown in block 410. For example, user interface module 202 can receive inputs from a user indicating a desired intensity via input interface 310, a default CCT value via input interface 320, and a desired color level of emitted light via input interface 330. In some embodiments, both a maximum CCT value (desired warmth at 100% intensity) and a minimum CCT value (desired warmth at a minimum intensity, such as near zero intensity) can be received, or a CCT shift value may be received. The first input, second input, and third input may be received as setup parameters for setting up default values for the intensity level, CCT value, and color setting prior to operation of the lighting devices 210-220. The first input, second input, and third input may also be received as runtime inputs for changing the parameters (and consequently, the characteristics of the emitted light) of lighting devices 210-220. In some embodiments, the third input is optional, and driver levels for adjusting the lighting warmth of emitted light may be determined solely via received inputs of default CCT values (i.e. maximum CCT, minimum CCT, and/or CCT shift value) and intensity level.

The method 400 further includes determining a white component color temperature value for the non-tungsten based lighting device based on the first input and the second input, as shown in block 420. For example, as described above in relation to FIG. 3, a dim-to-warm module 230 in the lighting controller engine 204 can calculate a white component color temperature that represents the emitted CCT value (e.g., the warmth of the emitted light desired from the non-tungsten based lighting device). The dim-to-warm module 230 can calculate the white component color temperature based on a scaling algorithm that outputs a white component in Kelvin units as a function of intensity entered as a percentage level.

The method 400 further includes determining, based on the white component color temperature value and the third input specifying the color setting, driver levels to control characteristics of the emitted light of the non-tungsten based lighting device. In one embodiment, as discussed above, the color converter module 232 can determine a color component output 360 and a saturation color component 370 from the user input color setting. The input interface 330 may receive color settings from a user via a variety of methods. For example, the user may select a desired color by selecting a point on a graphical depiction of a color gamut. Or the user may enter inputs specifying a color by entering relative values in a tri-stimulus color system or by entering values in a hue-saturation-intensity model. The color converter module 232 can interpret the user selections received in input interface 330 and determine the color component output 360 (i.e. the primary color inherent in the user's selections) and a saturation component 370 (i.e. the vividness of the primary color). In another embodiment, the user can enter the color component 360 and saturation component 370 directly into input interface 330, bypassing the need to convert the user input to the required color and saturation values.

The color component output 360 and the saturation component 370 are provided to the translator control module 234 along with the white component color temperature 350 and the user set intensity level 310. The translator control module 234 determines the driver levels for controlling the characteristics of the non-tungsten based lighting device. For example, if the non-tungsten based lighting device is a solid state lighting device, the driver levels indicate the specific electrical inputs to turn on or off the individual red, green, blue, amber, or other light emitting diodes in the solid state lighting unit and the amount of current to apply to each light emitting diode to adjust individual color intensity (i.e. brightness) levels. In response to the color component 360 being a non-white color, the translator control module 234 may determine driver levels independent of the white component color temperature 350. For example, when the color component 360 is a fully saturated color, the driver levels controlling the characteristics of the non-tungsten based lighting devices are a function of intensity, color, and saturation and the white component color temperature 350 need not be utilized. In response to the color component 360 being a non or partially saturated color, the translator control module 234 determines the driver levels according to the white component color temperature 350 to substantially mimic the warmth of white light emitted by a tungsten based light source or as defined by a blackbody line on a color gamut.

When the color component 360 is set as white, the driver levels can adjust the individual diodes in the solid state device to control the emitted CCT of the emitted light, which reflects the warmth of the emitted light. If the non-tungsten based lighting device is a gas discharge lighting device, the driver levels can indicate the specific inputs for driving motors to introduce and remove graduated filters of different colors to the lighting device. The driver levels can adjust the individual filters to control the CCT of the emitted light. As the driver levels are calculated based on the white component color temperature 350 (which in turn is calculated as a function of user set intensity level and saturation), the driver levels can adjust the warmth of the light emitted from the non-tungsten based lighting device as user set intensity is modified.

The process 400 also includes outputting the driver levels to the non-tungsten based lighting device, as shown in block 440. For example, the lighting control device 200 can output the determined driver levels to the non-tungsten based lighting devices 210-220 over a common interface 206.

The process 400 also includes scaling the white component color temperature 350 and driver levels responsive to changes received to the first input to reflect variations of the warmth of the emitted light, as shown in block 450. For example, during runtime operation of the lighting devices 210-220, the lighting control device 200 may continue to receive adjustments to the intensity level for one or more non-tungsten based lighting devices via input interface 310. The dim-to-warm module 230 can process any changes to the intensity level to output an adjusted white component color temperature 350. In turn, the translator control module 234 can process the adjustments to the white component color temperature 350 to determine updated driver levels 380 (for example, if the color component 360 remains a white color setting). The white component color temperature 350 and driver levels 380 are thus scaled as a function of user set intensity via an algorithm defining the operation of the dim-to-warm module 230 (as explained above with respect to block 420). As the white component color temperature 350 is gradually adjusted via increments or decrements in the user set intensity level, the CCT level of the emitted white light from the lighting control device is scaled.

For example, if the user decreases the intensity of a solid state lighting device and maintains the color component 360 as a white setting, the lighting control device 200 can increase the driver level applied to red/amber chips and decrease the driver level applied to blue chips included in the solid state lighting unit to reflect a warmer characteristic in the emitted white light. If the user increases the intensity of a solid state lighting device, the lighting control device 200 can decrease the driver level applied to red/amber chips and increase the driver level applied to blue chips in the solid state lighting device to reflect a cooler warmth characteristic in the emitted white light. The amount of current increased or decreased from each chip depends on the variation of the user input intensity level.

While the present subject matter has been described in detail with respect to specific aspects thereof, it will be appreciated that those skilled in the art, upon attaining an understanding of the foregoing, may readily produce alterations to, variations of, and equivalents to such aspects. Accordingly, it should be understood that the present disclosure has been presented for purposes of example rather than limitation and does not preclude inclusion of such modifications, variations, and/or additions to the present subject matter as would be readily apparent to one of ordinary skill in the art.

The invention claimed is:

1. A method for adjusting CCT values of a plurality of non-tungsten based lighting devices using a lighting control device, comprising:

receiving, at a user interface of the lighting control device, a first input specifying a desired intensity level and a second input specifying a maximum CCT value for the plurality of non-tungsten based lighting devices, wherein the maximum CCT value indicates a normalized maximum CCT limit at full intensity for the plurality of non-tungsten based lighting devices;

determining a white component color temperature value for the plurality of non-tungsten based lighting devices based on the first input and the second input, wherein the white component color temperature value is directly proportional to the first input specifying the desired intensity level;

determining, based on the white component color temperature value, driver levels to control characteristics of emitted light of the plurality of non-tungsten based lighting devices, wherein the driver levels include fixture-dependent values specific to each of the plurality of non-tungsten based lighting devices and wherein the characteristics of the emitted light include an emitted CCT value reflecting warmth of the emitted light;

outputting, via a common interface, the driver levels to the plurality of non-tungsten based lighting devices; and responsive to changes to the first input, modifying the white component color temperature value to reflect variations of the warmth of the emitted light of the plurality of non-tungsten based lighting devices as the first input is changed.

2. The method of claim 1, wherein at least one of the plurality of non-tungsten based lighting devices is a solid state lighting device, and wherein the driver levels to control the emitted CCT value of the emitted light include electrical inputs for activating or deactivating red, green, blue, amber, or other light emitting diodes in the solid state lighting device.

3. The method of claim 1, wherein at least one of the plurality of non-tungsten based devices is a gas discharge lighting device, and wherein the driver levels to control the emitted CCT value of the emitted light include commands to motors connected to the gas discharge lighting device to introduce or remove a cyan filter, a magenta filter, a yellow filter, or other filters to the gas discharge lighting device.

4. The method of claim 1, wherein the second input further specifies a minimum CCT value, and wherein the white component color temperature value is equal to the maximum CCT value minus the product of the desired intensity level and the difference of the maximum CCT value and the minimum CCT value.

5. The method of claim 1, wherein the plurality of non-tungsten based lighting devices includes a first lighting device and a second lighting device, wherein the first lighting device has a different control interface than the second lighting device, and wherein the fixture-dependent values comprise a first set of fixture-dependent values for the first lighting device and a second set of fixture-dependent values for the second lighting device.

6. The method of claim 1, wherein the common interface is a standardized interface following an ANSI E1.11 DMX512 protocol.

7. The method of claim 1, wherein the emitted CCT value that is adjusted responsive to adjustments of the white component color temperature value substantially mimics a warmth characteristic of a tungsten-based light source.

8. The method of claim 1, further comprising:

receiving, at the user interface, a third input specifying a color setting for the plurality of non-tungsten based lighting devices, wherein the driver levels to control characteristics of the emitted light are also based on the third input.

9. The method of claim 1, wherein the white component color temperature value is equal to the maximum CCT value in response to the first input being set to full intensity, wherein the white component color temperature value scales down linearly as a function of a pre-determined CCT shift value as the desired intensity level specified by the first input is reduced, and wherein the white component color temperature is equal to the maximum CCT value less the pre-determined CCT shift value in response to the intensity level specified by the first input being set to minimum intensity.

10. The method of claim 1, wherein the second input further specifies a CCT shift value indicating a number of Kelvin units the component color temperature shifts in response to the desired intensity level specified by the first input being reduced from full intensity to minimum intensity, and wherein the white component color temperature value scales down linearly as a function of the CCT shift value as the desired intensity level is reduced, the white component color temperature value equal to the maximum CCT value less the CCT shift value in response to the intensity level specified by the first input being set to minimum intensity.

11. A lighting control device for adjusting CCT values of one or more non-tungsten based lighting devices, comprising:

a user interface module configured to receive a first input specifying a desired intensity level and a second input specifying a maximum CCT value for the plurality of non-tungsten based lighting devices, wherein the maximum CCT value indicates a normalized maximum CCT limit at full intensity for the plurality of non-tungsten based lighting devices; and a lighting controller engine coupled to the user interface module, the lighting controller engine including:

a dim-to-warm module configured to determine a white component color temperature value for the plurality of non-tungsten based lighting devices based on the first input and the second input, wherein the white component color temperature value is directly proportional to the first input specifying the desired intensity level, wherein the white component color temperature value is adjusted responsive to changes to the first input, and a translator control module configured to determine, based on the white component color temperature value, driver levels to control characteristics of emitted light of the plurality of non-tungsten based lighting devices, wherein the driver levels include fixture-dependent values specific to each of the plurality of non-tungsten based lighting devices and wherein the characteristics of the emitted light include an emitted CCT value that is adjusted responsive to adjustments of the white component color temperature value, the emitted CCT level reflecting variations of warmth of the emitted light.

12. The lighting control device of claim 11, wherein at least one of the plurality of non-tungsten based lighting devices is a solid state lighting device, and wherein the driver levels to control the emitted CCT value of the emitted light include electrical inputs for activating or deactivating red, green, blue, amber, or other light emitting diodes in the solid state lighting device.

13. The lighting control device of claim 11, wherein at least one of the plurality of non-tungsten based devices is a gas discharge lighting device, and wherein the driver levels to control the emitted CCT value of the emitted light include commands to motors connected to the gas discharge lighting device to introduce or remove a cyan filter, a magenta filter, a yellow filter, or other filters to the gas discharge lighting device.

14. The lighting control device of claim 11, wherein the second input further specifies a minimum CCT value, and wherein the white component color temperature value is equal to the maximum CCT value minus the product of the desired intensity level and the difference of the maximum CCT value and the minimum CCT value.

15. The lighting control device of claim 11, wherein the plurality of non-tungsten based lighting devices includes a first lighting device and a second lighting device, wherein the first lighting device has a different control interface than the second lighting device, and wherein the fixture-dependent values comprise a first set of fixture-dependent values for the first lighting device and a second set of fixture-dependent values for the second lighting device.

16. The lighting control device of claim 11, wherein the lighting control device is communicatively coupled to the one or more lighting control devices via a common interface following an ANSI E1.11 DMX512 protocol.

17. The lighting control device of claim 11, wherein the emitted CCT value that is adjusted responsive to adjustments of the white component color temperature value substantially mimics a warmth characteristic of a tungsten-based light source.

18. The lighting control device of claim 11, wherein the user interface is further configured to receive a third input specifying a desired color setting of emitted light, and wherein the translator control module is configured to determine the driver levels to control the characteristics of emitted light based on the white component color temperature value and based on the third input specifying the desired color setting.

19. The lighting control device of claim 11, wherein the white component color temperature value is equal to the maximum CCT value in response to the first input being set to full intensity, wherein the white component color temperature value scales down linearly as a function of a pre-determined CCT shift value as the desired intensity level specified by the first input is reduced, and wherein the white component color temperature value is equal to the maximum CCT value less the pre-determined CCT shift value in response to the intensity level specified by the first input being set to minimum intensity.

20. The lighting control device of claim 11, wherein the second input further specifies a CCT shift value indicating a number of Kelvin units the component color temperature shifts in response to the desired intensity level specified by the first input being reduced from full intensity to minimum intensity, and wherein the white component color temperature value scales down linearly as a function of the CCT shift value as the desired intensity level is reduced, the white component color temperature value equal to the maximum CCT value less the CCT shift value in response to the intensity level specified by the first input being set to minimum intensity.

* * * * *